US005245797A

United States Patent [19]

Milkie

[11] Patent Number: 5,245,797

[45] Date of Patent: Sep. 21, 1993

[54] MANUAL SANDER

[76] Inventor: Terry H. Milkie, 3800 Steeles Ave. W., Suite 9, Woodbridge, Ontario, L4L 4G9, Canada

[21] Appl. No.: 917,309

[22] Filed: Jul. 23, 1992

[51] Int. Cl.[5] ..... B24D 15/04; B24B 55/10

[52] U.S. Cl. ..... 51/393; 51/383; 51/273; 51/180

[58] Field of Search ..... 51/358, 382, 383, 385, 51/389, 390, 391, 392, 393, 273, 180, 170 TL, 174, 386, 387; 15/144.1, 145

[56] References Cited

U.S. PATENT DOCUMENTS

| | | | |
|---|---|---|---|
| 1,501,192 | 7/1924 | Severns | 51/392 |
| 1,544,368 | 6/1925 | Brennan | 51/390 |
| 2,499,933 | 3/1950 | Smul | 51/358 |
| 2,711,059 | 6/1955 | Ames | 51/393 |
| 2,722,789 | 11/1955 | Robins | 51/170 TL |
| 3,224,149 | 12/1965 | Harrington | 51/386 |
| 3,395,415 | 8/1968 | Leland | 15/144.1 |
| 3,826,045 | 7/1974 | Champayne | 51/170 T |
| 3,967,417 | 7/1976 | Jurak | 51/170 TL |
| 4,368,598 | 1/1983 | Kuhlmann | 51/170 R |
| 4,616,449 | 10/1986 | Marton | 51/273 |
| 4,697,389 | 10/1987 | Bornine | 51/273 |
| 4,779,385 | 10/1988 | Reiter | 51/273 |
| 4,937,984 | 7/1990 | Taranto | 51/392 |
| 5,007,206 | 4/1991 | Paterson | 51/180 |
| 5,193,313 | 3/1993 | Sanchez et al. | 51/392 |

FOREIGN PATENT DOCUMENTS

| | | | |
|---|---|---|---|
| 276297 | 2/1966 | Austria | 15/144.1 |
| 2720622 | 11/1978 | Fed. Rep. of Germany | 15/145 |

OTHER PUBLICATIONS

Black and Decker sander advertisement from *Canadian Workshop* Mar. 1991, vol. 14, No. 6.

Black and Decker sander advertisement from *Home Mechanix*, Nov. 1990, vol. 86, No. 750.

*Primary Examiner*—Bruce M. Kisliuk

*Assistant Examiner*—Bryan Reichenbach

[57] ABSTRACT

A manual sanding tool has a block for holding a sheet of sand paper and a housing which may be attached to the block. The block has two ridges, each with a convex top surface. The two ridges are proximate opposed sides of the block; a shaft projects from the block inwardly of, and adjacent to, each ridge. An inverted box shaped member associated with each ridge has an elongate slot which receives the shaft such that the box member may be wiped over the top of the ridge to a position on the back surface of the block. In wiping over the top surface of the ridge, the box shaped member pulls on the end of any sandpaper between it and the ridge in order to tighten the sandpaper on the block. A nut may then secure the box shaped member in place on the back surface of the ridge. A passageway through a clip attached to the housing may receive a smaller diameter hook. The hook terminates in a socket for receiving a pole. This arrangement forms a reach extension for the tool with the hook and larger diameter passageway acting as a universal joint.

19 Claims, 6 Drawing Sheets

MANUAL SANDER

BACKGROUND OF THE INVENTION

1. Field of the Invention

This invention relates to a manually operated sanding tool and has particular application for such a tool when adapted for attachment to a vacuum supply.

2. Description of the Related Art

Manual sanders typically comprise a sanding block with clamps to retain a sheet of sand paper on the block In use, the sandpaper may buckle or rapidly wear due to the sandpaper not being sufficiently taut. Also, difficulties arise when the surface to be sanded is out of reach. A ladder may be used, but this slows progress and is somewhat hazardous. Manual sanders may generate a considerable amount of dust. This is particularly deleterious for those with dust allergies.

This invention seeks to overcome drawbacks of the known prior art.

SUMMARY OF THE INVENTION

According to the present invention, there is provided a manual sanding tool comprising the following: a block having a front surface for supporting a sheet of abrasive material, a back surface, and sides; a ridge extending along said back surface of said block in alignment with a side of said block, said ridge terminating along its length in a convex surface; clamp means supported on said back surface for clamping a sheet of abrasive material, said clamp means having a clamping member and means to clamp said clamping member to said block and to unclamp said clamping member, said clamping member, when unclamped, being moveable toward and away from said back surface of said block free of any biasing means and being independently moveable transversely of said ridge free of any biasing means so as to have two degrees of freedom whereby said clamping member may be positioned on said ridge and thereafter slid onto the back surface of said block adjacent said ridge; and a housing releasably attached to said In accordance with another aspect of the invention, there is provided a manual sanding tool comprising the following: a block having a front surface for supporting a sheet of abrasive material and a back surface; clamp means supported on said back surface for clamping a sheet of abrasive material; a housing releasably attached to said block so as to leave exposed said front surface of said block; a passageway associated with said housing; a reach extension member terminating at one end in a hook with an arcuate segment for reception in said passageway; said passageway having a larger diameter than said arcuate segment of said hook such that said arcuate segment is rotatably and slidably received within said passageway.

BRIEF DESCRIPTION OF THE DRAWINGS

In the figures which disclose example embodiments of the invention.

DESCRIPTION OF THE PREFERRED EMBODIMENTS

Figure 1:
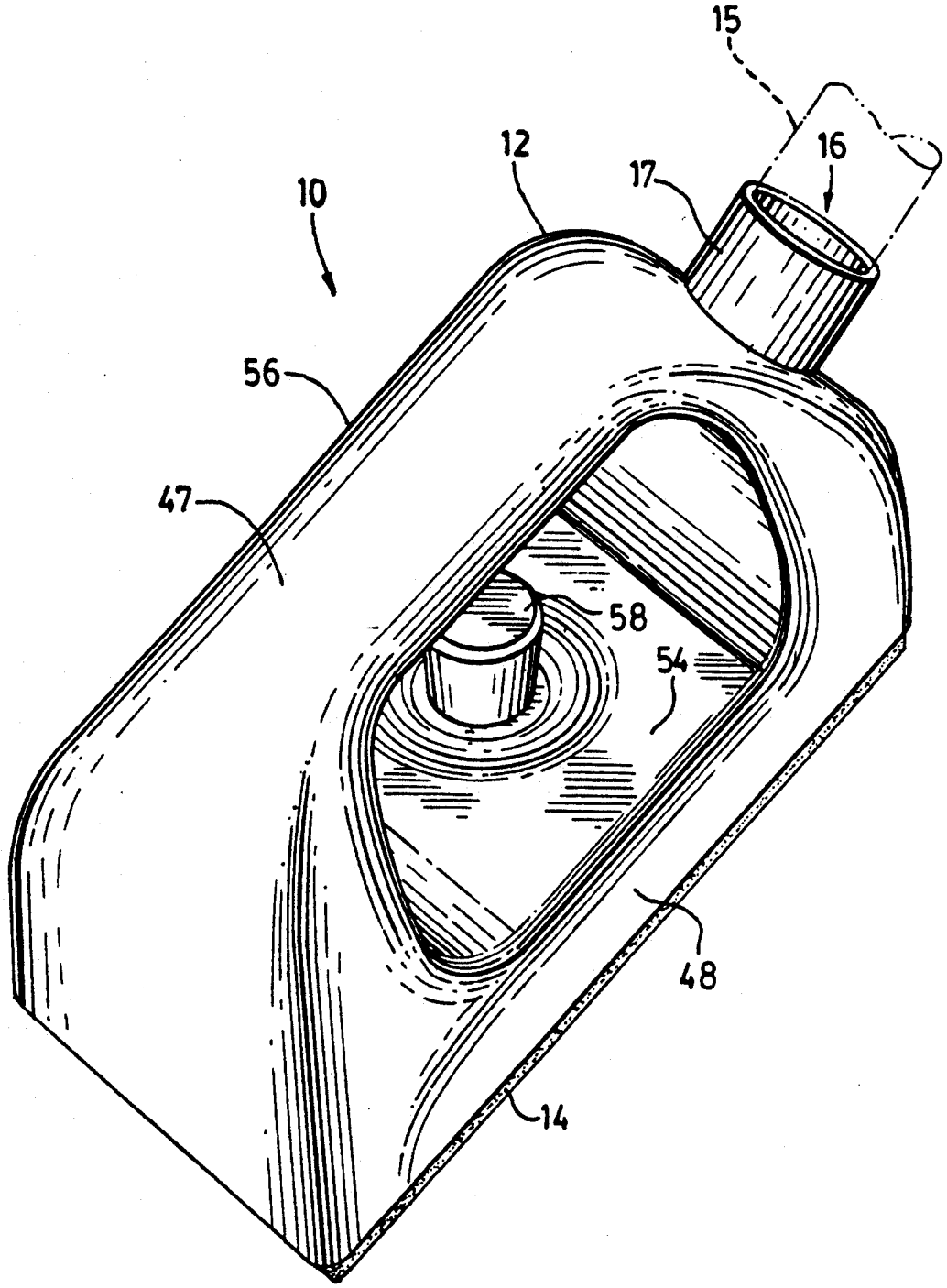
FIG. 1 is a perspective view of manual sanding tool made in accordance with this invention.

With reference to FIG. 1, a manual sanding tool 10 comprises a housing 12 and a block 14. The housing has a port 16 through tube 17; the tube of the housing is adapted for mating with a hose (shown in phantom in FIG. 1 at 15) for supplying a vacuum. Thus, tube 16 may be sized to mate with a hose from a household vacuum cleaner.

Figure 2:
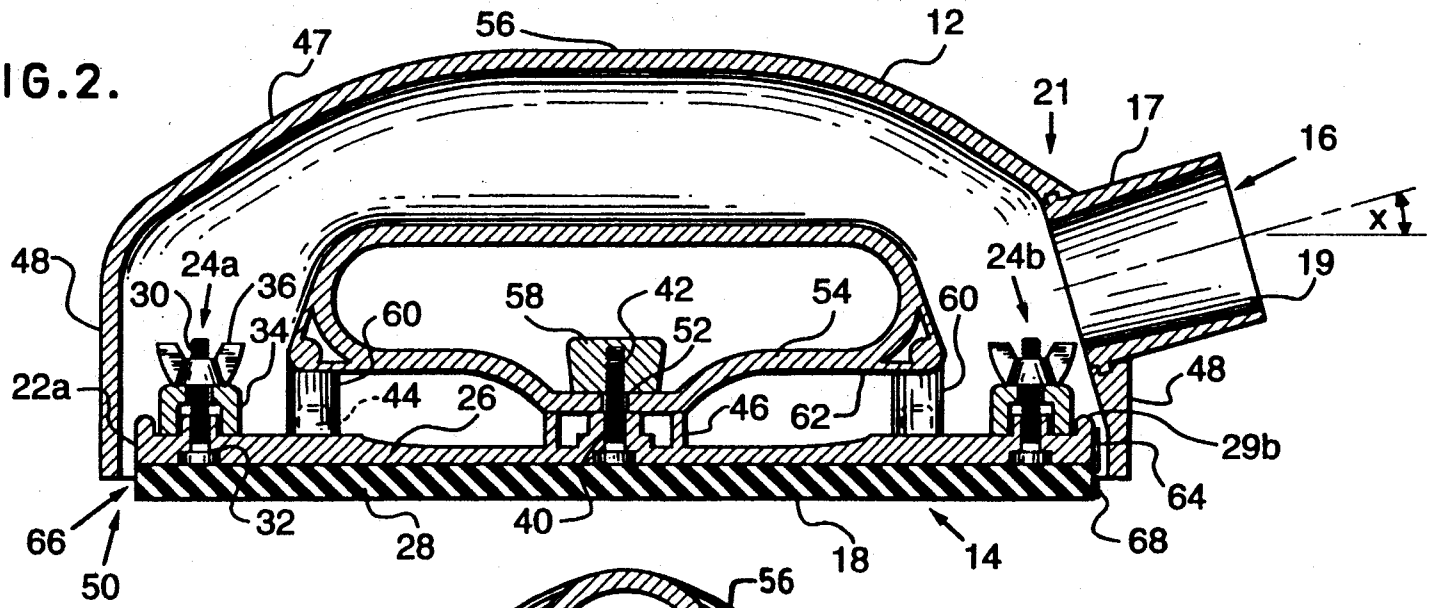
FIG. 2 is a medial side sectional view of the sanding tool of FIG. 1.
Figure 3:
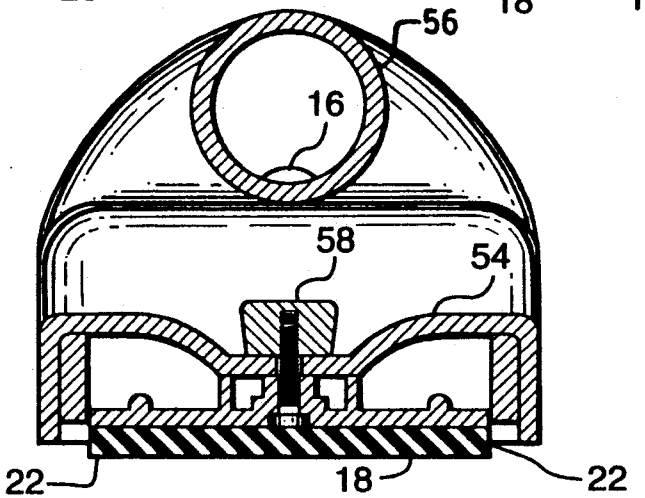
FIG. 3 is a medial end sectional view of the sanding tool of FIG. 1.
Figure 4:
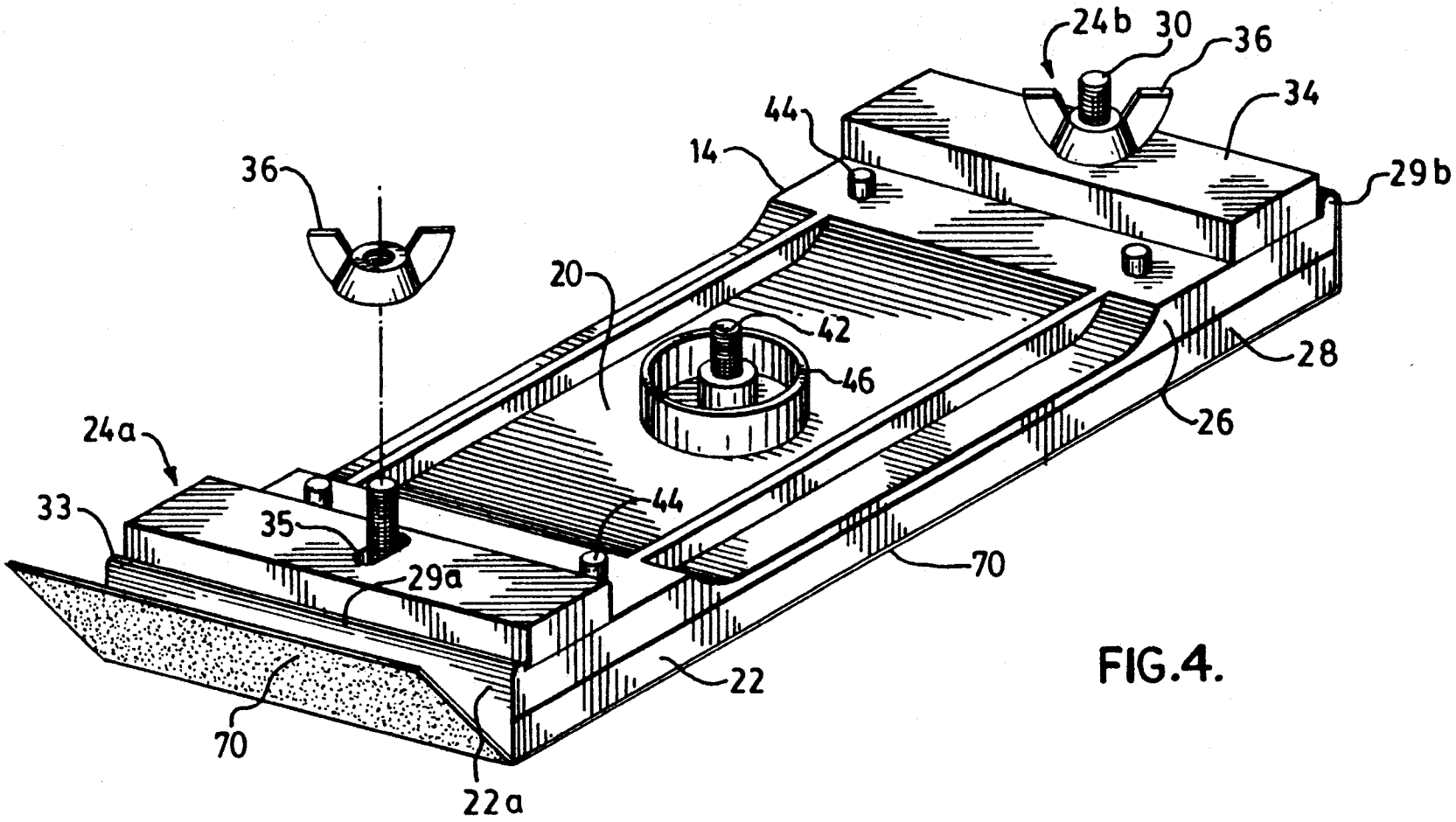
FIG. 4 is a perspective view of a portion of the manual sanding tool of FIG. 1 shown with a sheet of abrasive material.

With reference to FIGS. 2 through 4, block 14 comprises a base 26 with a sponge foam pad 28 glued thereto. The block has a front surface 18, back surface 20, and side surfaces 22. Two spaced ridges 29*a*, 29*b* extend along the back surface 20 of the block with ridge 29*a* at, and parallel to side 22*a* of the block and ridge 29*b* at, and parallel to, opposed side 22*b* of the block. The ridges have a convex top surface 33 along their length. The block has clamps 24*a*, 24*b* associated with ridges 29*a*, 29*b*, respectively. Each clamp comprises a bolt 30 with its head received within a well 32 in the base 26 and its threaded shaft projecting from the back surface of the block proximate, and inwardly of, one of the ridges 29*a*, 29*b*. Each clamp also comprises a clamping member which is an inverted box shaped member 34 with an elongated central slot 35 which receives the shaft of bolt 30 and a wing nut 36 which threads to the bolt. With this arrangement, it will be apparent that the inverted box shaped member 34 is slidable between a first position on the convex surface of its associated ridge 29*a* or 29*b* (illustrated in FIG. 5*a*) and a second position on the back surface of the block adjacent and inwardly of its associated ridge (illustrated in FIG. 5*b*) such that the inverted box shaped members intervene between the ridges when they are in their respective second positions.

The base 26 of block 14 also has a central well 40 which receives the head of bolt 42 such that the threaded shaft of the bolt projects from the back surface of the block. Locating posts 44 also project from the back surface 20 of the block as does flange 46 which surrounds a portion of the threaded shaft of bolt 42.

Referring to FIGS. 2 and 3, it is seen that tube 17 is mounted to the side wall 48 of the housing by a swivel joint 21 and that the interior surface 19 of the tube is tapered so that the tube will mate with a tapered hose of a vacuum cleaner. The tube 17 (and hence port 16) is angled away from the front surface 18 of block 14 at an angle×of fifteen to twenty degrees.

With reference to FIGS. 1, 2, and 3, the housing 12 comprises a top wall 47 and side walls 48. A portion of the housing is curved in on itself to form a base wall 54 and a handle 56 such that the handle forms a conduit, that is, such that the interior of the handle is in fluid communication with the remainder of the housing. The housing is open only at its base 50, port 16 and opening 52 in base wall 54. Four locating cups 60 project downwardly from the front surface 62 of base wall 54.

Opening 52 in base wall 54 is sized to receive the threaded shaft of bolt 42 projecting from block 14. Furthermore, opening 52 and the locating cups 60 are positioned so that when the housing is in the intended orientation with respect to the block, bolt may be received by opening 52 and the locating cups may receive locating posts 44 of the block. In this position, the front surface 62 of the base wall 54 abuts the top of flange 46 of the block. A knurled nut 58 may then be threaded to the shaft of bolt 42 to releasably attach the housing 12 to the block 14.

The housing is sized so that when it is releasably attached to the block as aforedescribed, the housing is spaced from the block and surrounds the back of the block and a portion 64 of the sides of the block proximate the back of the block so as to provide a gap 66 between the sides 22 of the block and the side walls 48 of the housing. Furthermore, a portion 68 of the block proximate the front of the block extends outside of the housing; this distance 68 between the bottom of the housing and the front surface of the block is chosen to be about one-eighth of an inch. The tool is constructed so that the gap 66 is approximately three sixteenths of an inch around most of the periphery of the base.

Figure 5A:
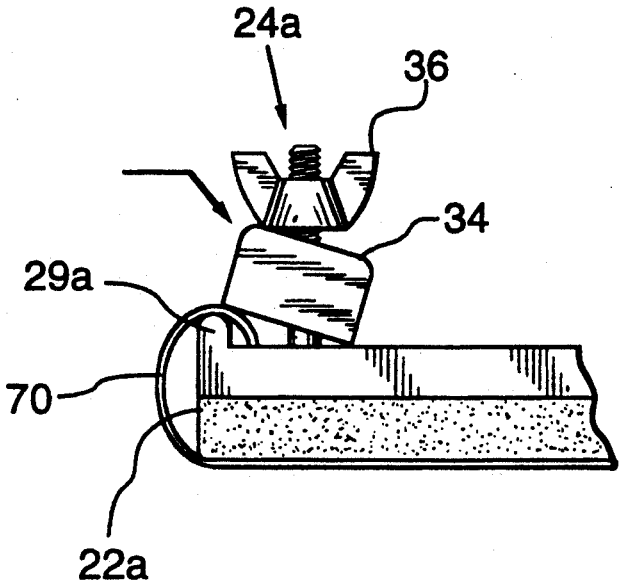
FIGS. 5*a* and 5*b* are side views of an end portion of the sanding tool portion of FIG. 4.
Figure 5B:
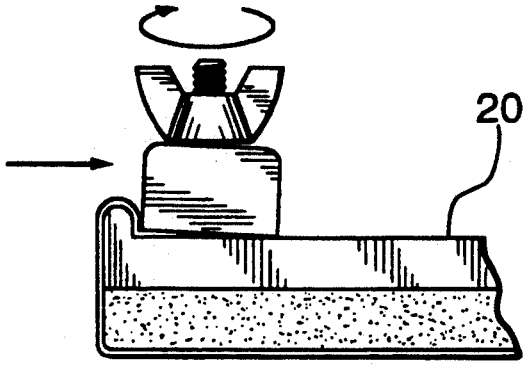

To affix a sheet of sandpaper 70 (or other sheet having an abrasive surface) to the sanding tool of this invention, the block 14 is first removed from housing 12 by unscrewing knurled nut 58. With reference to FIGS. 4 and 5, wing nuts 36 of the block are then loosened and one end of the sandpaper is inserted under the inverted box member 34 of clamp 24*b* and the wing nut of that clamp is then tightened to clamp that end of the sand paper. The sandpaper is then curled around the front surface 18 of the block, pulled taut, and its free end inserted between ridge 29*a* and the inverted box member 34 of clamp 24*a* while this box member 34 is in a first position illustrated in FIG. 5*a*. This box member is then wiped along the convex surface 33 of the ridge 29*a* until it reaches a second position on the back surface 20 of the block, as illustrated in FIG. 5*b*. This wiping action further tightens the sandpaper 70 on the block. The wing nut of clamp 24*a* is then tightened. In this way, the sandpaper is retained on the front surface of the block and is taut. With reference to FIGS. 2 and 3, the housing may then be lowered onto the block with the opening 52 receiving the bolt 42 and the locating cups 60 receiving the locating posts 44. Knurled nut 58 may then be screwed onto bolt 42 in order to attach the housing to the block. It will be apparent that this arrangement allows for quick changing of the sandpaper, when desired.

After affixing sandpaper to the tool, turning to FIG. 1, a hose 15 from a vacuum supply may be mated with the port 16 of the housing and the vacuum supply activated. When the sanding tool is used to abrade a surface, dust resulting from the abrading will either lie loosely on the abraded surface or fall from the surface. In the former case, as the tool moves over the surface, this loose dust is picked up by the vacuum acting through the gap 66 around the periphery of the block. In the latter case, as the dust falls past the periphery of the block, it is again picked up by the vacuum acting through gap 66.

Swivel joint 21 allows the tube 17 to rotate freely in order to relieve any twisting stress developing in the vacuum hose while using the device. The angle $\times$ between the front surface of the block and the tube 17 helps ensure the vacuum hose does not interfere with the abrading operation. Choosing angle $\times$ at fifteen to twenty degrees has been found to be optimum for this purpose.

In some instances, the hose of an available household vacuum will fit directly into port 16, in other instances an adapter may be necessary between the vacuum hose and port 16. The block must extend outside of the housing so that, in use, the bottom of the housing does not contact the surface being abraded thereby interfering with the abrading operation. On the other hand, the block must not project too far outside of the housing or the vacuum available at the abraded surface will be insufficient to pick up dust. The one-eighth inch projection of the block noted hereinbefore has been found satisfactory in achieving both of these criteria.

Figure 6A:
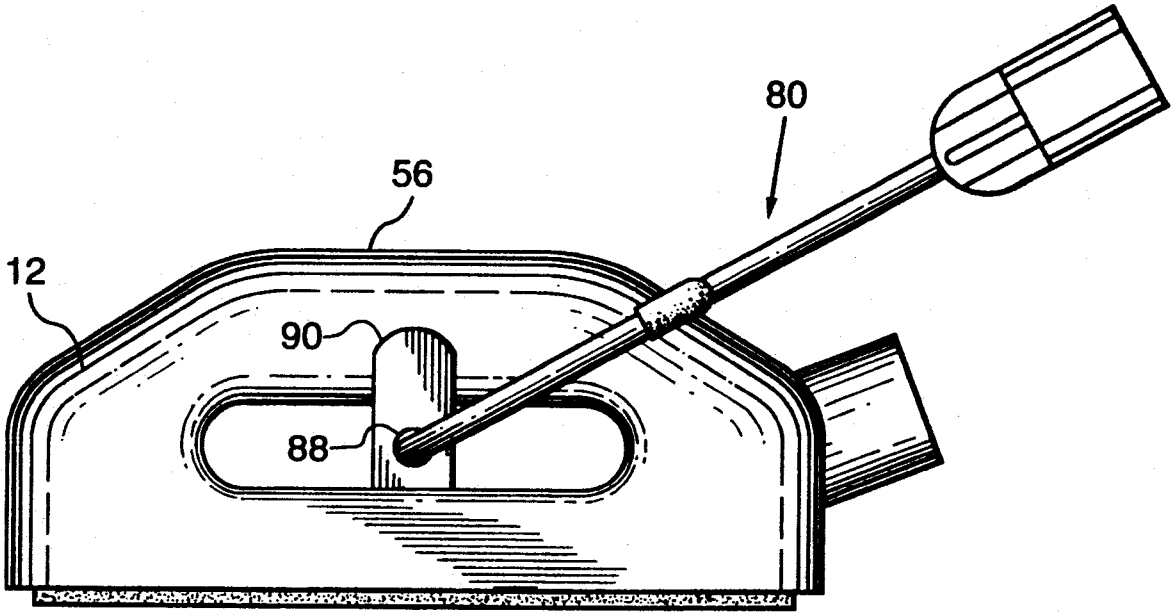
FIG. 6 is a top and side view of a sanding tool made in accordance with another aspect of this invention.
Figure 6B:
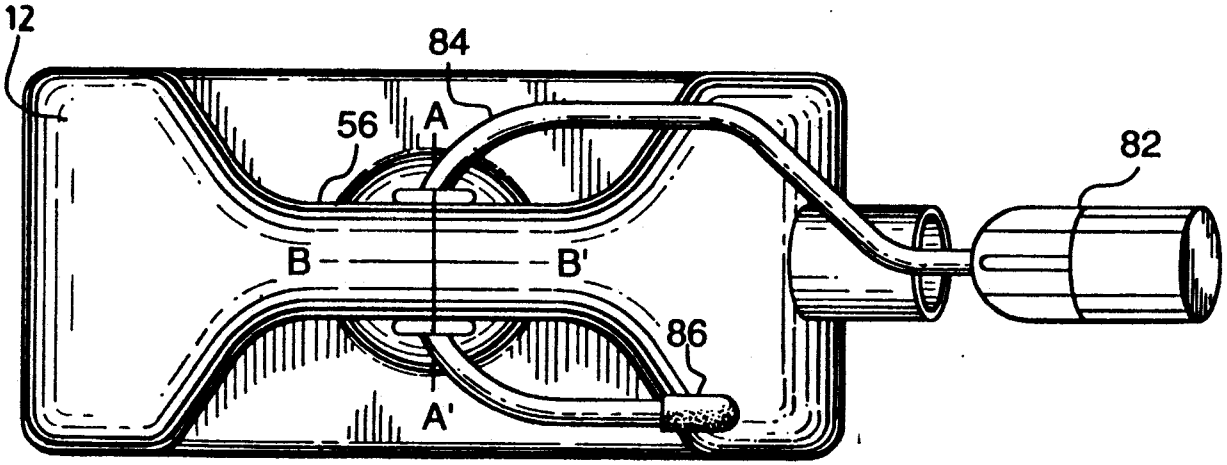
Figure 7:
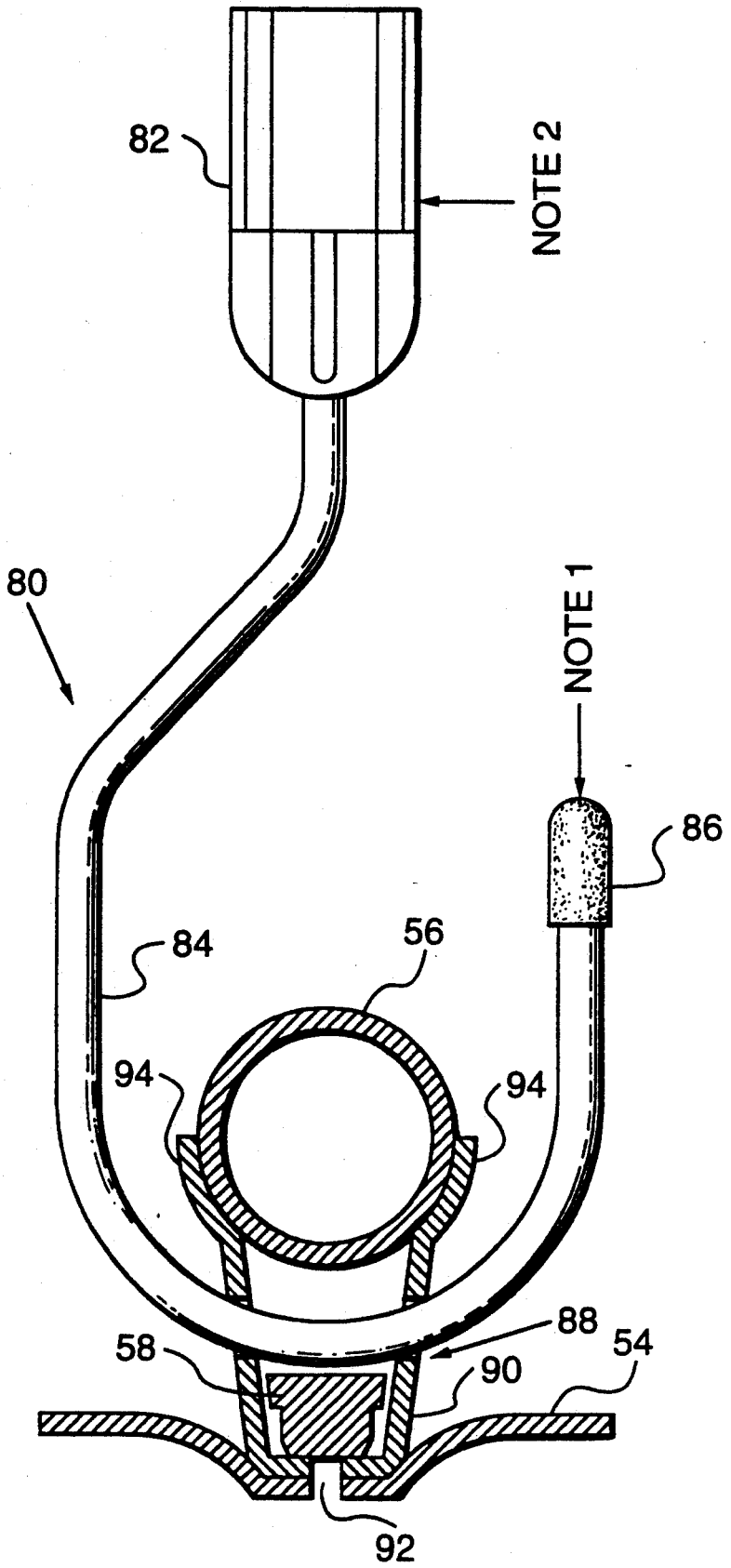
FIG. 7 is a cross-sectional view along the line A—A of FIG. 6.

Turning now to FIGS. 6 and 7 which illustrate another aspect of the sanding tool of this invention, a reach extension member 80 comprises a threaded socket 82 for receiving a pole and a hook 84 terminating in an enlarged head 86. The hook 84 is received within a passageway 88 in a clip 90 which is of larger diameter than the hook. Clip 90 has a central opening 92 and resilient arms 94. The resilient arms may cup handle 56 of housing 12 with the central opening positioned on base wall 54 of housing 12 so as to receive threaded shaft 42 of base 14 (see FIG. 4). In this way knurled nut 58 may be threaded to the shaft 42 so that the clip is retained in position. As seen in FIG. 6, when in position within the clip, the hook 84 has a width less than that of housing 12.

Enlarged head 86 of the member 80 may be a plastic button which is pushed over the end of hook 84.

The reach extension member may be installed in the sanding tool of FIG. 1 by removing the knurled nut 58, positioning clip 90 as aforenoted and then rethreading knurled nut 58 onto shaft 42 (FIG. 4). Next, the enlarged head 86 of the hook is removed and the hook inserted through passageway 88 whereupon the enlarged head is pushed back onto the hook. A pole may then be threaded to socket 82.

Once in place, the hook may rotate and slip within passageway 88 so as to provide a universal type joint which allows the sander 10 to be used in practically any orientation. The force is applied to the pole low and close to the centreline of the block 14 which prevents the sander from tipping when used in a side-to-side motion.

It will be apparent that the reach extension member 80 and clip 90 may be readily removed and attached so that the sander may be easily adapted for use with in-reach and out-of-reach applications.

Other modifications will be apparent to those skilled in the art and, accordingly, the invention is defined in the claims.

What is claimed is:

1. A manual sanding tool comprising the following:

a block having a front surface for supporting a sheet of abrasive material, a back surface, and sides;

a ridge extending along said back surface of said block in alignment with a side of said block;

clamp means supported on said back surface for clamping a sheet of abrasive material, said clamp means having a clamping member and means to clamp said clamping member to said block and to unclamp said clamping member, said clamping member, when unclamped, being moveable toward and away from said back surface of said block free of any biasing means and being independently moveable transversely of said ridge free of any biasing means so as to have two degrees of freedom whereby said clamping member may be positioned on said ridge and thereafter slid onto the back surface of said block adjacent said ridge; and a housing releasably attached to said block so as to leave exposed said front surface of said block.

2. The manual sanding tool of claim 1 wherein said ridge terminates along its length in a convex surface.

3. The manual sanding tool of claim 2 further including a shaft projecting from the back surface of said block proximate said ridge and wherein said clamping member has an elongate slot receiving said shaft, said shaft and elongate slot cooperating to permit said clamping member to move toward and away from said block and transversely of said ridge.

4. The manual sanding tool of claim 3 including a further ridge extending along said back surface of said block in alignment with said side of said block, said further ridge terminating along its length in a convex surface, said further ridge spaced from said ridge and wherein said clamp means has a further clamping member and means to clamp said further clamping member to said block and to unclamp said clamping member, said further clamping member, when unclamped, being moveable toward and away from said back surface of said block and being movable transversely of said further ridge whereby said further clamping member may be positioned on said convex surface of said further ridge and thereafter slid onto the back surface of said block adjacent said further ridge, such that said clamping members intervene between said ridges when said clamping members have been slid onto the back surface of said block.

5. The manual sanding tool of claim 4 wherein said ridge is proximate one side of said block and said further ridge is proximate a side of said block opposite said one side.

6. The manual sanding tool of claim 3 wherein said means to clamp comprises said shaft and a threaded nut and wherein said shaft is threaded and receives said threaded nut.

7. The manual sanding tool of claim 6 including a passageway associated with said housing and a reach extension member terminating at one end in a hook with an arcuate segment for reception in said passageway.

8. The manual sanding block of claim 7 wherein said hook terminates in an enlarged head to retain said hook within said passageway.

9. The manual sanding tool of claim 8 wherein said reach extension member terminates at its other end in a receptacle for receiving a pole.

10. The manual sanding tool of claim 9 wherein said housing has a handle and a base portion, said base portion being releasably attached to said block, said base portion being spaced from said handle and including a clip releasably supported between said base portion and said handle, said clip incorporating said passageway.

11. The manual sanding tool of claim 10 wherein said passageway has a larger diameter than said hook to permit slipping of said hook within said passageway.

12. The manual sanding tool of claim 11 wherein said block comprises a housing retaining threaded shaft projecting therefrom and wherein said base portion of said housing has an opening for receiving said housing retaining shaft and wherein said tool further comprises a nut for threading to said housing retaining threaded shaft in order to releasably attach said housing to said block.

13. The manual sanding tool of claim 12 wherein said housing is spaced from and surrounds said back surface of said block and a portion of said sides of said block proximate said back surface of said block so as to provide a gap between the sides of said block and said housing and so that a portion of said block proximate the front surface of said block extends outside of said housing, said housing having a port adapted for mating with a supply hose of a vacuum supply.

14. The manual sanding tool of claim 13 wherein said housing includes a conduit which communicates any vacuum applied to said housing, said conduit forming said handle.

15. A manual sanding tool comprising the following:

a block having a front surface for supporting a sheet of abrasive material and a back surface;

clamp means supported on said back surface for clamping a sheet of abrasive material;

a housing releasably attached to said block so as to leave exposed said front surface of said block;

a passageway associated with said housing;

a reach extension member terminating at one end in a hook with an arcuate segment for reception in said passageway;

said passageway having a larger diameter than said arcuate segment of said hook such that said arcuate segment is rotatably and slidably received within said passageway.

16. The manual sanding tool of claim 15 wherein said hook terminates in an enlarged head to retain said hook within said passageway.

17. The manual sanding tool of claim 16 wherein said reach extension member terminates at its other end in a receptacle for receiving a pole.

18. The manual sanding tool of claim 17 wherein said housing has a handle and a base portion, said base portion being releasably attached to said block, said base portion being spaced from said handle and including a clip releasably supported between said base portion and said handle, said clip incorporating said passageway.

19. The manual sanding tool of claim 16 wherein said arcuate segment is generally U-shaped.

* * * * *